US011628123B2

(12) United States Patent
Chambers

(10) Patent No.: US 11,628,123 B2
(45) Date of Patent: Apr. 18, 2023

(54) LOW COST AND UNIVERSAL PILL BOTTLE REGIMEN TRACKER WITH INTERCHANGEABLE LABELS

(71) Applicant: Mammoth Werks LLC, Carlsbad, CA (US)

(72) Inventor: Casey M. Chambers, Carlsbad, CA (US)

(73) Assignee: MAMMOTH WERKS LLC, Carlsbad, CA (US)

( * ) Notice: Subject to any disclaimer, the term of this patent is extended or adjusted under 35 U.S.C. 154(b) by 302 days.

(21) Appl. No.: 17/105,916

(22) Filed: Nov. 27, 2020

(65) Prior Publication Data

US 2022/0168188 A1 Jun. 2, 2022

(51) Int. Cl.

| | |
|---|---|
| ***B65D 83/04*** | (2006.01) |
| ***A61J 7/04*** | (2006.01) |
| ***A61J 7/00*** | (2006.01) |

(52) U.S. Cl.

CPC ..... *A61J 7/0436* (2015.05); *A61J 7/0076* (2013.01); *A61J 2205/30* (2013.01)

(58) Field of Classification Search

CPC ..... A61J 1/1412; A61J 7/0436; A61J 7/0076; A61J 7/04; A61J 2205/30

USPC ..... 206/459.1, 534; 116/279; 215/228, 230

See application file for complete search history.

(56) References Cited

U.S. PATENT DOCUMENTS

| | | | | |
|---|---|---|---|---|
| 2,450,949 | A | 10/1948 | Salvadore et al. | |
| 2,587,147 | A | 2/1952 | Guion et al. | |
| 5,009,338 | A | 4/1991 | Barker | |
| 5,277,325 | A | 1/1994 | Yan | |
| 5,577,335 | A | 11/1996 | Tucker | |
| 5,638,970 | A * | 6/1997 | Garby | G06M 1/248 215/230 |
| 5,678,712 | A * | 10/1997 | Rios | B65D 50/041 215/230 |
| D490,707 | S | 6/2004 | Mataya | |
| 7,314,022 | B2 | 1/2008 | Sollaccio | |
| D591,633 | S | 5/2009 | Valle | |
| 7,661,384 | B2 | 2/2010 | Mataya | |
| 8,201,691 | B1 * | 6/2012 | Chowdhury | A61J 7/04 116/306 |
| 8,534,220 | B1 | 9/2013 | Olson | |
| 2005/0205595 | A1 * | 9/2005 | Lepke | G07F 11/54 221/87 |

(Continued)

*Primary Examiner* — Luan K Bui

(74) *Attorney, Agent, or Firm* — John L. Rogitz; John M. Rogitz

(57) ABSTRACT

A pill bottle top includes a top and a base engaged with the top and having first ratchet teeth. An indicator slide has a finger pad formed with an inwardly protruding indicator nose and leaf spring arms coupled to the finger pad and disposed intermediate the top and base. The leaf spring arms are formed with second ratchet teeth configured to engage first ratchet teeth on the base. The finger pad can be pressed against the leaf spring arms to disengage the second ratchet teeth from the first ratchet teeth and allow the indicator slide to slide relative to the top with the indicator nose higher than and alignable with time indicia on the top. The finger pad can be released to allow the second ratchet teeth to engage first ratchet teeth under material bias of the leaf spring arms and prevent the indicator slide from sliding.

19 Claims, 9 Drawing Sheets

(56) References Cited

U.S. PATENT DOCUMENTS

| | | | | |
|---|---|---|---|---|
| 2007/0007301 | A1* | 1/2007 | Kaplan | G07F 17/0092 221/288 |
| 2007/0251909 | A1* | 11/2007 | Decelles | B65D 47/0828 215/221 |
| 2009/0127157 | A1* | 5/2009 | Costa | B65D 83/0409 206/534 |
| 2011/0284415 | A1 | 11/2011 | Balakier et al. | |
| 2012/0160863 | A1* | 6/2012 | Thompson | B65D 50/046 221/8 |
| 2014/0008319 | A1 | 1/2014 | Buxton-Dakides | |
| 2014/0332494 | A1* | 11/2014 | Balakier | B65D 1/0246 215/365 |

* cited by examiner

LOW COST AND UNIVERSAL PILL BOTTLE REGIMEN TRACKER WITH INTERCHANGEABLE LABELS

FIELD

This disclosure relates to low cost and universal pill bottle regimen trackers with interchangeable labels.

BACKGROUND

As understood herein, the market needs a simplified and very low-cost pill regimen tracker, but current designs are either too complicated, expensive, or require special bottle and top combinations in order to work.

SUMMARY

As further recognized herein, the above problems can be addressed using techniques described herein which can be applied to many existing pill bottle tops regardless of size or closure method and does one thing easily and simply, namely, manually recording a last dose taken. Designs are provided for extremely low-cost injection molding processes and low-cost materials. Adhesive labelling is disclosed for interchangeability of tracking time intervals, retail branding and SKU count reduction.

Accordingly, an apparatus includes a disc-shaped label and a disc-shaped top having a top surface supporting the label. A disc-shaped base is engaged with the top. The base includes an outer periphery defining an inner surface and plural first ratchet teeth spaced around the inner surface. An indicator slide includes a finger pad formed with an inwardly protruding indicator nose and leaf spring arms coupled to the finger pad through first and second legs and disposed intermediate the top and base. The leaf spring arms are formed with at least one second ratchet tooth configured to engage first ratchet teeth on the base and being deformable under pressure from the finger pad. The finger pad is pressable inwardly against the leaf spring arms to disengage the second ratchet tooth from the first ratchet teeth and allow the indicator slide to slide relative to the top with the indicator nose higher than and alignable with time indicia on the label. The finger pad is releasable to allow the second ratchet tooth to engage first ratchet teeth under material bias of the leaf spring arms and prevent the indicator slide from sliding around the top.

If desired, the label can be waterproof. The label may be an indicator label.

In some embodiments, the indicator slide includes at least two second ratchet teeth.

In example implementations, the finger pad is shaped as an arcuate plate and the leaf spring arms are arcuate. The finger pad may be intermediate ends of the leaf spring arms.

In example embodiments, a dust ring may be disposed in a slot formed between the top and base, with an outer periphery of the dust ring being substantially flush with outer peripheries of the top and base. The dust ring may be integral with the indicator slide, or it may not be integral with the indicator slide.

In another aspect, a pill bottle top includes a top with a top surface supporting time indicia, a base engaged with the top and comprising first ratchet teeth, and an indicator slide with a finger pad formed with an inwardly-protruding indicator and resilient arms coupled to the finger pad. The arms are formed with at least one second ratchet tooth configured to engage first ratchet teeth on the base and being deformable under pressure from the finger pad. The finger pad is pressable inwardly toward the arms to deform the arms to disengage the second ratchet tooth from the first ratchet teeth and allow the indicator slide to slide relative to the top with the indicator higher than and alignable with the time indicia. The finger pad can be released to allow the second ratchet tooth to engage first ratchet teeth under material bias of the arms and prevent the indicator slide from sliding.

In another aspect, a method includes pressing a pad inwardly toward resilient arcuate arms to disengage ratchet teeth on the arms from ratchet teeth on a base and allow an indicator slide comprising the pad and arms to slide relative to the base with an indicator on the pad higher than and alignable with time indicia on a top engaged with the base. The method also includes releasing the pad to allow the ratchet teeth on the arms to engage the ratchet teeth on the base under material bias of the arms and prevent the indicator slide from sliding around the top.

The details of the present application, both as to its structure and operation, can best be understood in reference to the accompanying drawings, in which like reference numerals refer to like parts, and in which:

DETAILED DESCRIPTION

Figure 1:
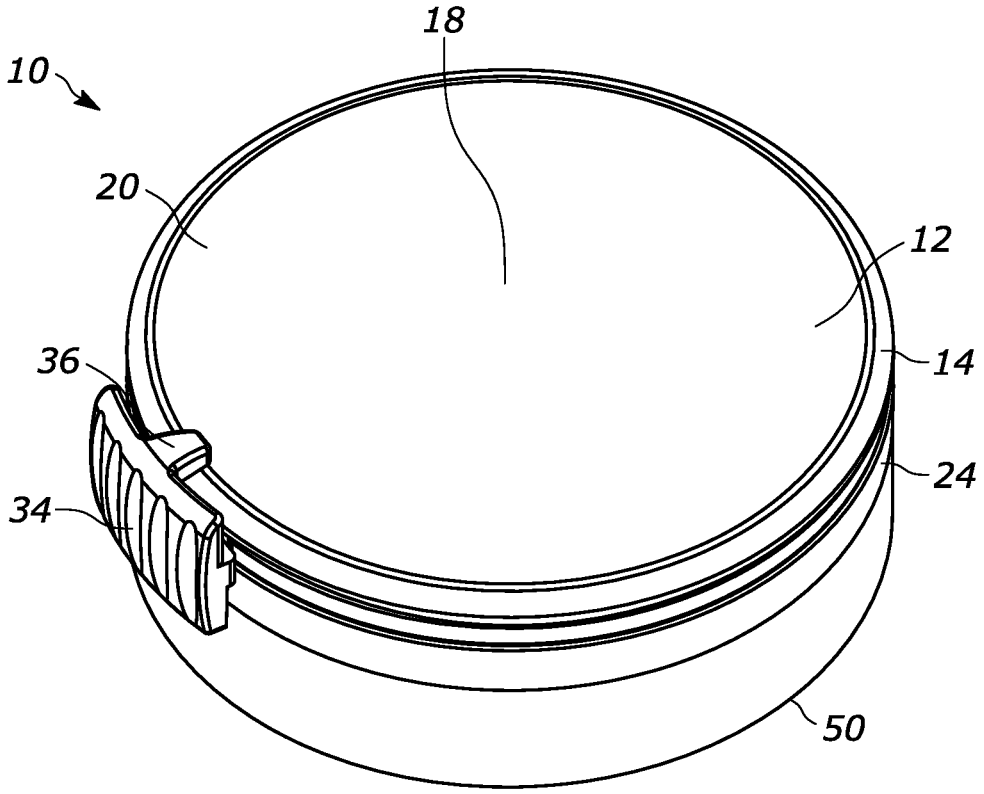
FIG. 1 is a perspective view of the pill bottle top.
Figure 2:
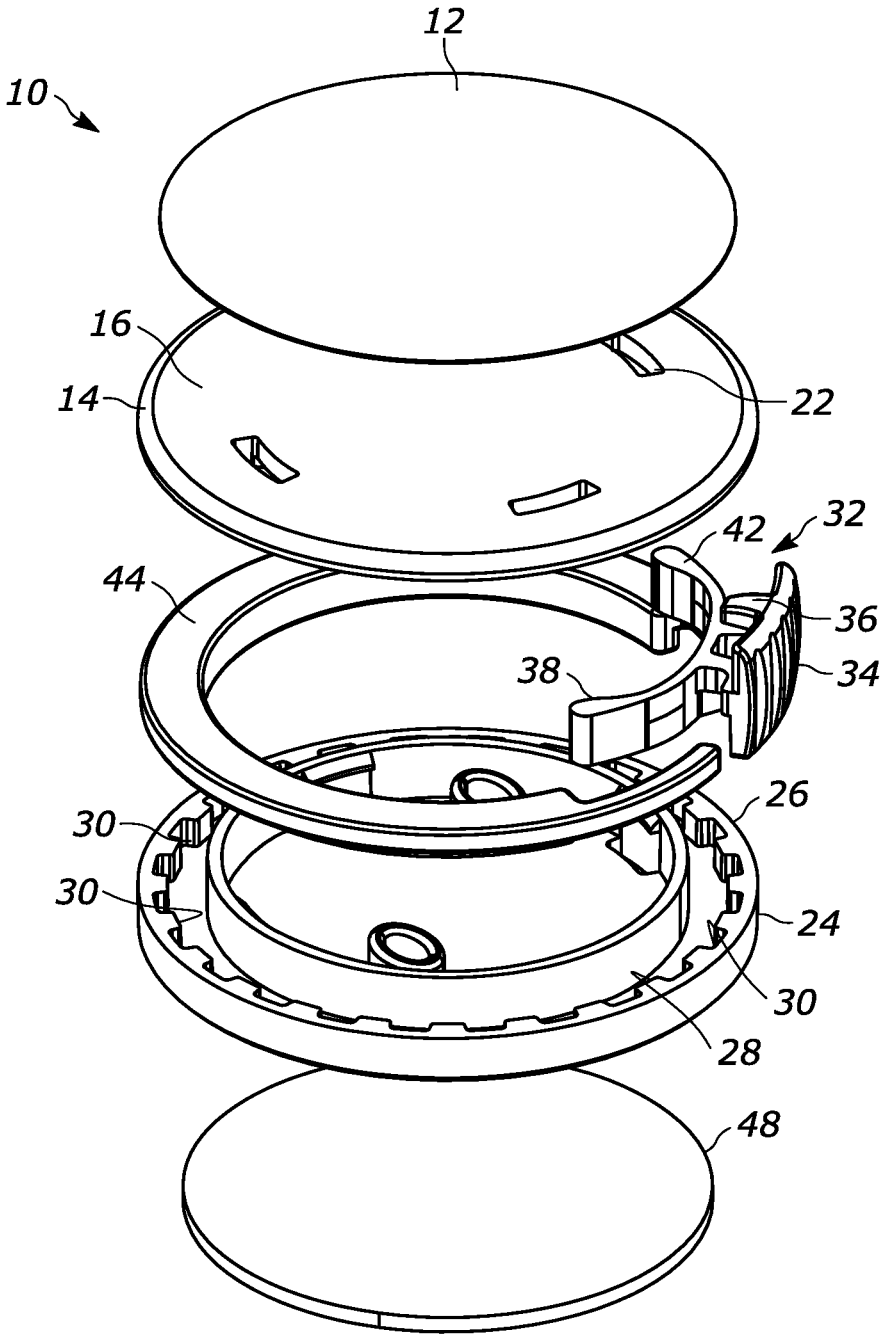
FIG. 2 is an exploded isometric view of the pill bottle top from a first perspective.
Figure 3:
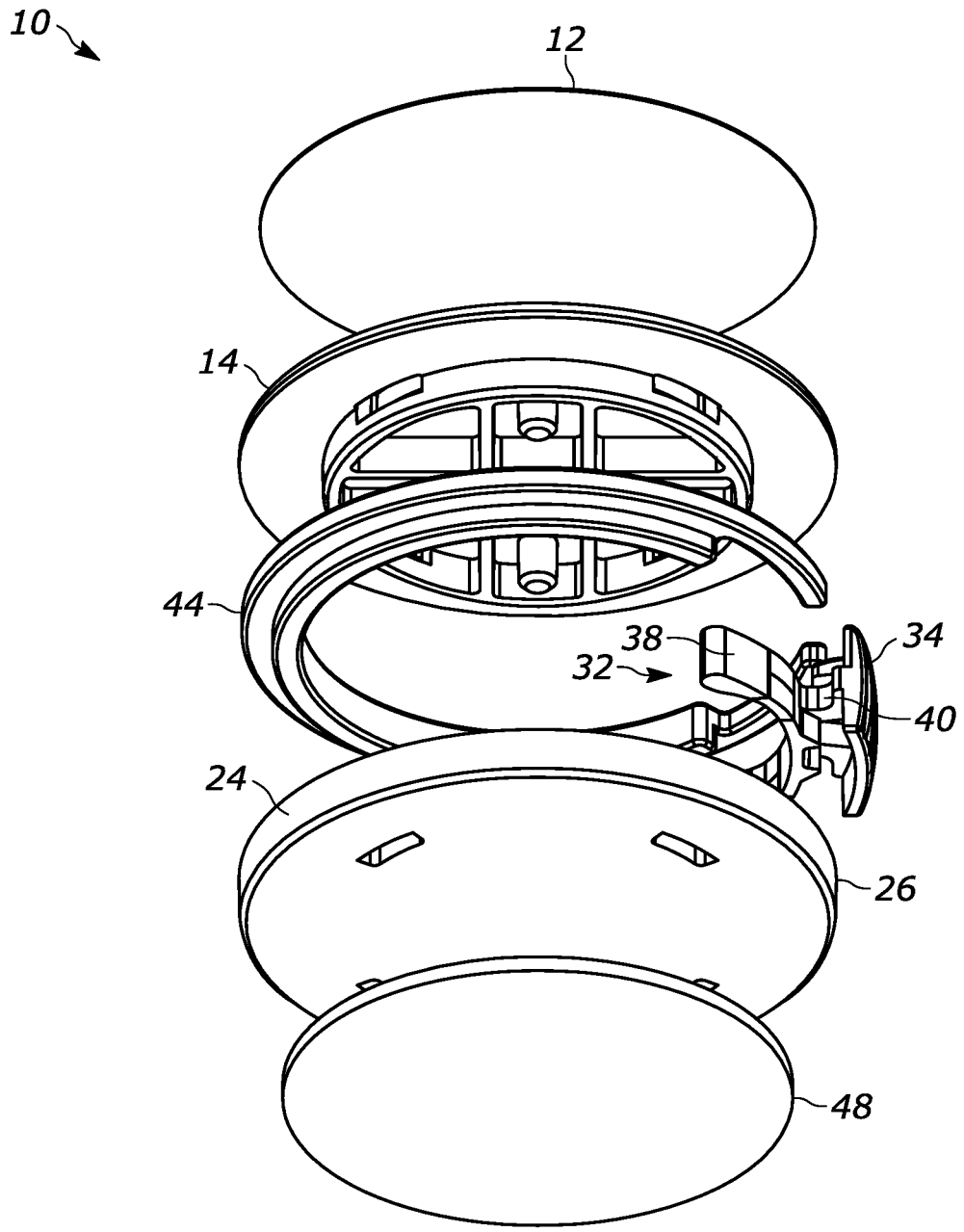
FIG. 3 is an exploded isometric view of the pill bottle top from a second perspective.

Referring initially to FIGS. 1-3, a pill bottle cap 10 includes a disc-shaped label 12 and a disc-shaped top 14 having a top surface 16 supporting the label 12. The label 12 may be adhered to the top surface 16 and may include printed indicia including alpha-numeric identifying information 18 and, around its outer edge, numbers 20 in the manner of a clock face. The numbers 20 align with ratchet rest positions of the indicator nose as set forth in greater detail below. In one example, the label 12 is made of water resistant or waterproof material such as thin film vinyl.

The top surface 16 may be a substantially solid, complete disk except for plural (in the embodiment shown, four equally spaced) manufacturing apertures 22 to facilitate molding. Thus, it may be appreciated that the top 14 can, like the other components of the cap 10, be made of plastic. Alternative materials include lightweight metal. Further details of the top 14 are disclosed below in reference to FIG. 6.

A disc-shaped base 24 is engaged with the top 14 and in one embodiment is snappingly engaged with the top. The base 24 includes a raised outer periphery 26 defining an inner surface 28 and plural ratchet teeth 30 spaced around the inner surface 28 as shown. Preferably, 24 ratchet teeth ae provided with an equal number of ratchet positions between respective adjacent teeth, essentially spaces between adjacent ratchet teeth. This provides for 24 hourly increments, with midnight being used as "Off" position, and allows for seven days with morning, mid-day and night positions for each day, with the eighth day (remaining three positions) labeled as "off" that may be used to indicate the regimen is complete and the cap 10 is stored or discarded.

It will be appreciated that the disc of the base 24, when engaged with an upright pill bottle, is generally horizontal, and that the outer periphery 26 consequently rises vertically from the disc. Other terms of direction used herein are referenced to this orientation.

An indicator slide 32 includes a finger pad 34 formed near or at its top edge with an inwardly-protruding indicator nose 36 (FIGS. 1 and 2) and leaf spring arms 38 coupled to the finger pad 34 through first and second legs 40 (FIG. 3). The indicator slide 32 is disposed intermediate the top 14 and base 24. In example implementations, the finger pad 34 is shaped as an arcuate plate as shown, and the leaf spring arms 38 are arcuate and extend from side edges of the pad 34 such that the finger pad 34 is intermediate ends 42 (FIG. 2) of the leaf spring arms 38.

Figure 7:
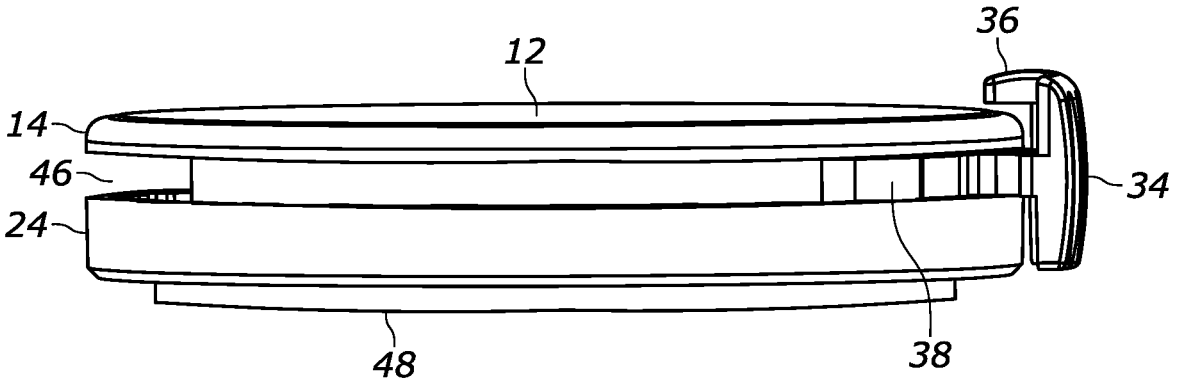
FIG. 7 is an isometric view from the edge of the pill bottle top.
Figure 8:
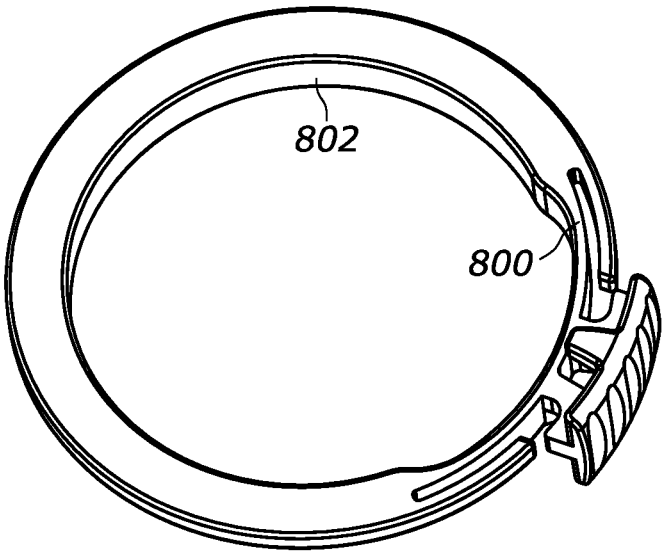
FIGS. 8 and 9 illustrate an alternate indicator slide integrated with the dust ring.
Figure 9:
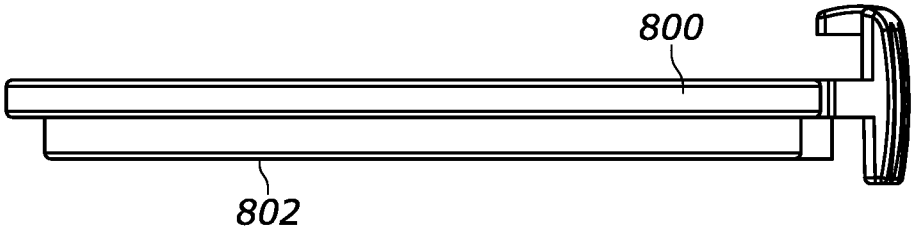

In example embodiments, a dust ring 44 formed as a flat ring (a ring with a rectangular transverse cross-section) may be disposed in a slot formed between the top 14 and base 24, with the leaf spring arms 38 of the indicator slide 32 slidably engaged with the slot. The slot is best shown at 46 in FIG. 7, and the dust ring 44 locks debris from entering the slot 46. Returning to FIG. 2, it will be appreciated that the outer periphery of the dust ring 44 is substantially flush with the outer peripheries of the top 14 and base 24. The dust ring 44 may not be integral with the indicator slide 32 as shown in FIGS. 2 and 3, or it may be integral with the indicator slide as shown in FIGS. 8 and 9, showing an indicator slide 800 that is in all essential respects identical to the indicator slide 32 shown in FIGS. 1-3 except that a dust ring 802 is made integrally with the indicator slide 800 to form a completely enclosed ring. The dust ring 802 may extend below the indicator slide 800 as shown in FIG. 9.

Completing the description of FIGS. 1-3, the bottom surface of the base 24 may be covered by an adhesive foam tape 48 or similar structure with adhesive on both sides, to that the tape 48 can be adhered to the base 24 with its downward-facing surface covered with a peel-away release liner. The liner can be peeled away and the tape 48 (and, hence, entire cap 10) can be adhered to the top of a pill bottle 50 (FIG. 1).

Figure 4:
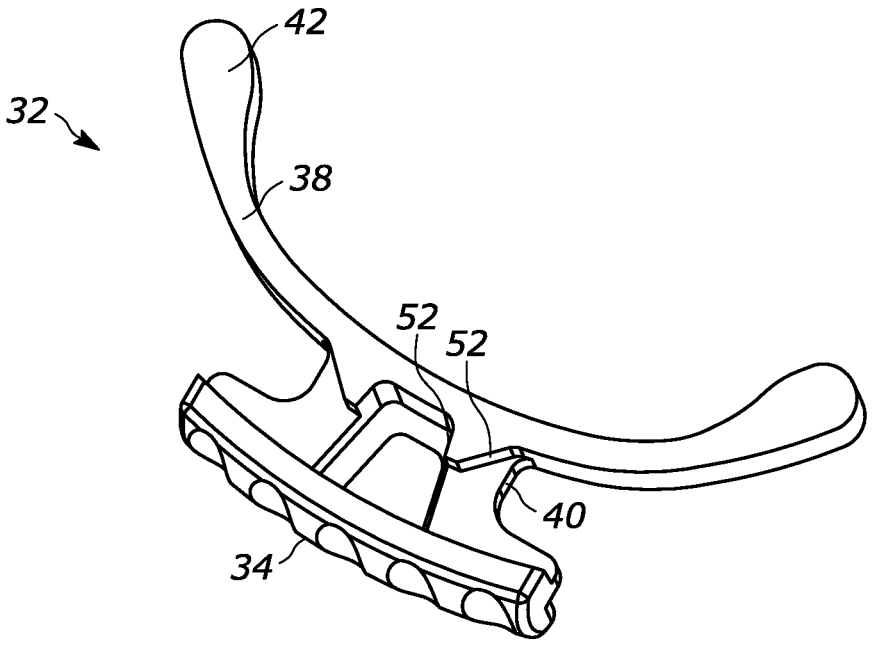
FIG. 4 is an isometric view of the leaf spring arms and finger pad from a bottom perspective.
Figure 4A:
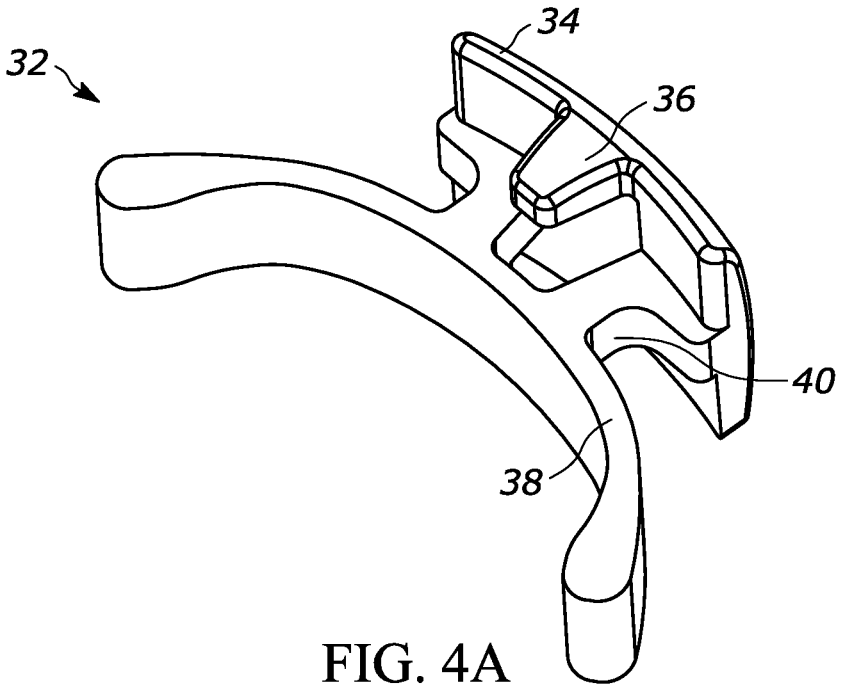
FIG. 4A is an isometric view of the leaf spring arms and finger pad from a top perspective.
Figure 5:
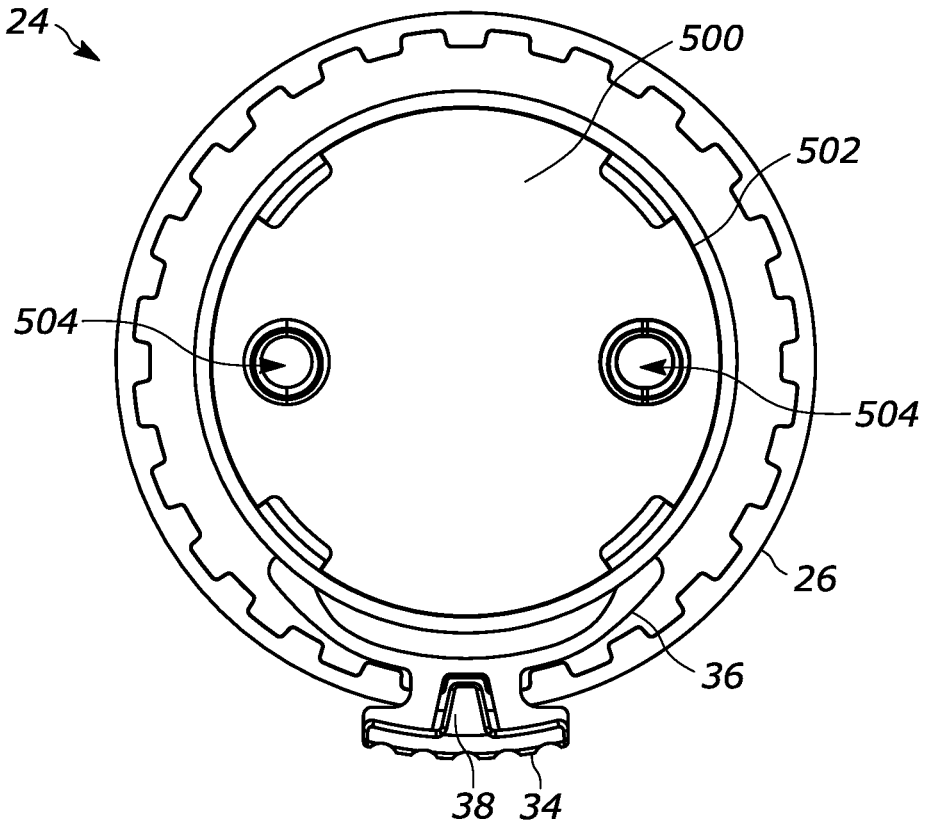
FIG. 5 is a plan view of the top of the pill bottle top.
Figure 5A:
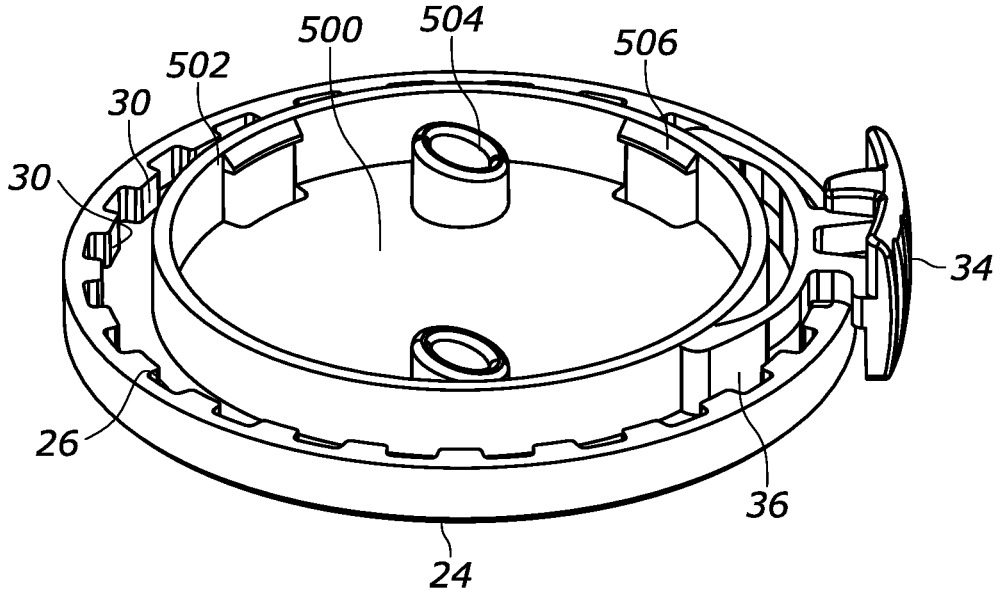
FIG. 5A is an isometric view of the base shown in FIG. 5.
Figure 6:
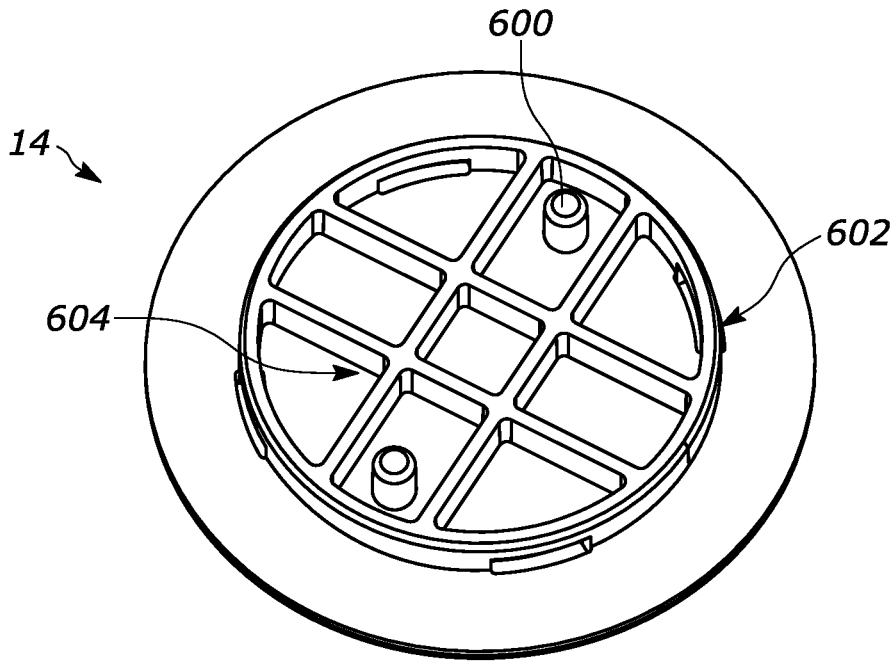
FIG. 6 is an isometric view showing the bottom surface of the top of the pill bottle top.

FIGS. 4 and 4A illustrate details of the indicator slide 32, FIGS. 5 and 5A illustrate details of the base 24, and FIG. 6 illustrates details of the top 14.

As shown best in FIG. 4, the leaf spring arms 38 of the indicator slide 32 are formed with at least one and in the example shown two ratchet teeth 52 configured to engage the ratchet teeth 30 on the base 24. The legs 40 that couple the finger pad 34 to the leaf spring arms 38 extend above the ratchet teeth 52 to avoid interfering with the engagement between the teeth 52, 30.

It may be appreciated that the leaf spring arms 38 are deformable under inward pressure from the finger pad 34. Thus, the finger pad 34 can be pressed by a person inwardly against the leaf spring arms 38 to disengage the ratchet teeth 52 of the leaf spring arms from spaces between adjacent ratchet teeth 30 of the base 24. This allows the indicator slide 32 to slide under hand pressure relative to the top 14 (and base 24) with the indicator nose 36 higher than and alignable with the time indicia 20 on the label 12. In this way, the user can align the nose with the contemporaneous time indicated on the label 12 at which the pill bottle 50 is most recently opened. The finger pad 34 can then be released to allow the ratchet teeth 52 on the leaf spring arms 38 to engage a space between ratchet teeth 30 of the base 24 under material bias of the leaf spring arms 38, preventing the indicator slide 32 from sliding relative to the top 14 and base 24.

FIGS. 5 and 5A illustrate additional features of the base 24 while FIG. 6 illustrates additional features of the top 14 that cooperate with features of the base 24 shown in FIGS. 5 and 5A. The top surface 500 of the base 24 is formed with a complete inner ring 502 the raised periphery of which is concentric with the raised outer periphery 26. It is to be appreciated that when the leaf spring arms 36 are disposed as shown between the inner ring 502 and outer periphery 26 in an interference fit, a spring preload is established that preload on the leaf spring arms 36. The spring preload serves to hold the subassembly together, thus providing ease of final assembly of the product.

Within the inner ring 502 are plural (in the example shown, two) generally cylindrical alignment bosses 504 rising up from the top surface 500 of the base 24. The alignment bosses 504 mate with respective alignment pins 600 on the bottom of the top 14. This aligns the label increments 20 to ratchet positions and prevents rotation of the components relative to each other. If desired, the top edges of the bosses 504 may be beveled at an oblique angle relative to horizontal to allow for easy assembly and adequate pin capture in the bosses.

As best shown in FIG. 5A, the surface 500 of the base 24 also may be formed with snap teeth 506 which provide the holding force to close the assembly. With greater specificity and in cross-reference to FIGS. 5A and 6, the snap teeth 506 engage snap bridges 602 in the top 14. The snap bridges 602 may be established by an inner ring that is concentric with the outer edge of the top 14 and if desired in combination with the manufacturing apertures 22 to capture the snap teeth 506 and provide the reaction force to hold the assembly together. The snap bridges are designed for simplified and inexpensive injection mold tooling.

If desired, straight stiffness ribs 604 may be provided on the top 14 as shown to provide strength and stiffness to the assembled product.

Figure 10:
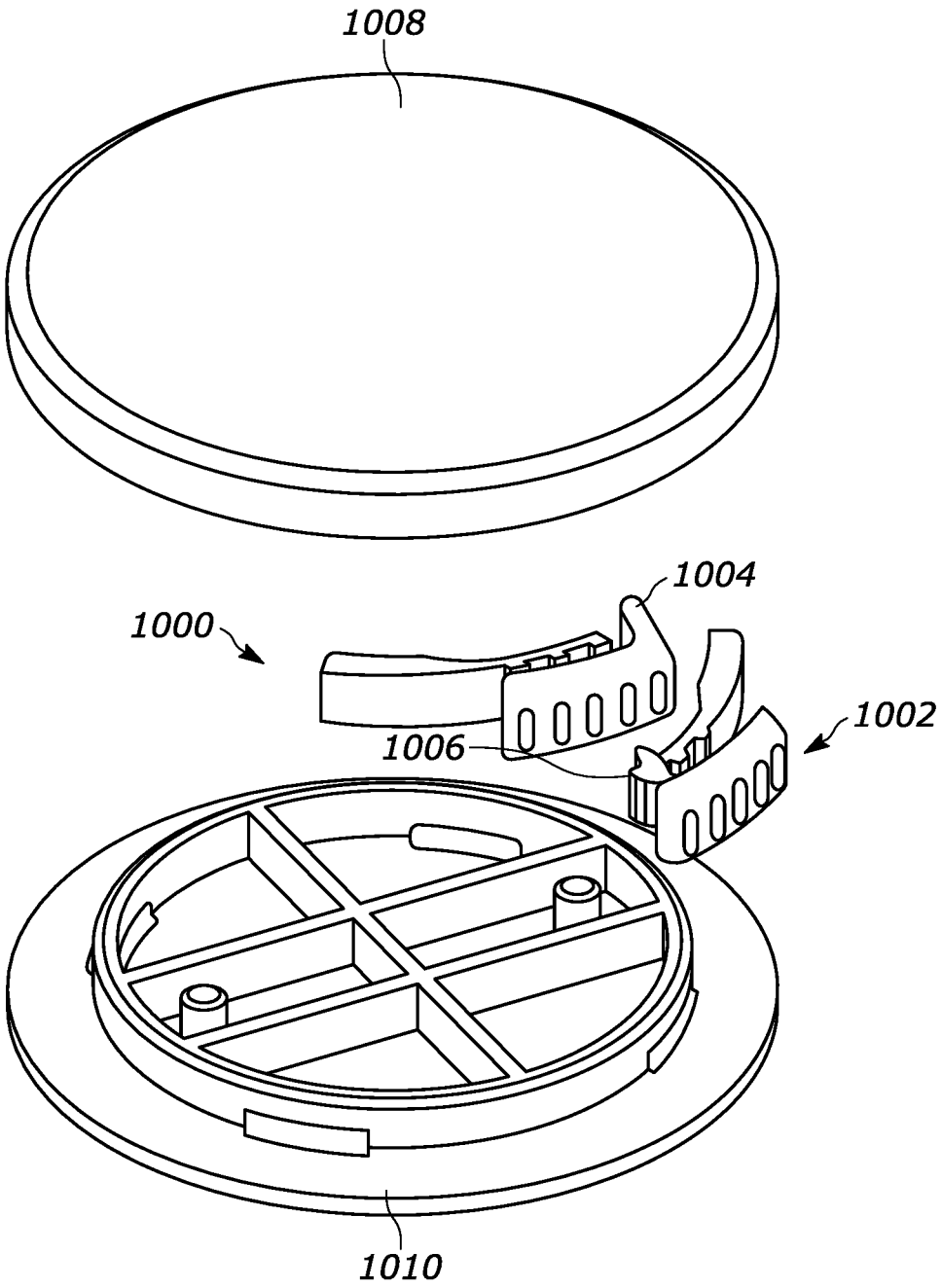
FIGS. 10 and 11 illustrate two indicators, in which one "leads" and the other "follows", FIG. 10 being an exploded isometric view and FIG. 11 being a bottom plan view.
Figure 11:
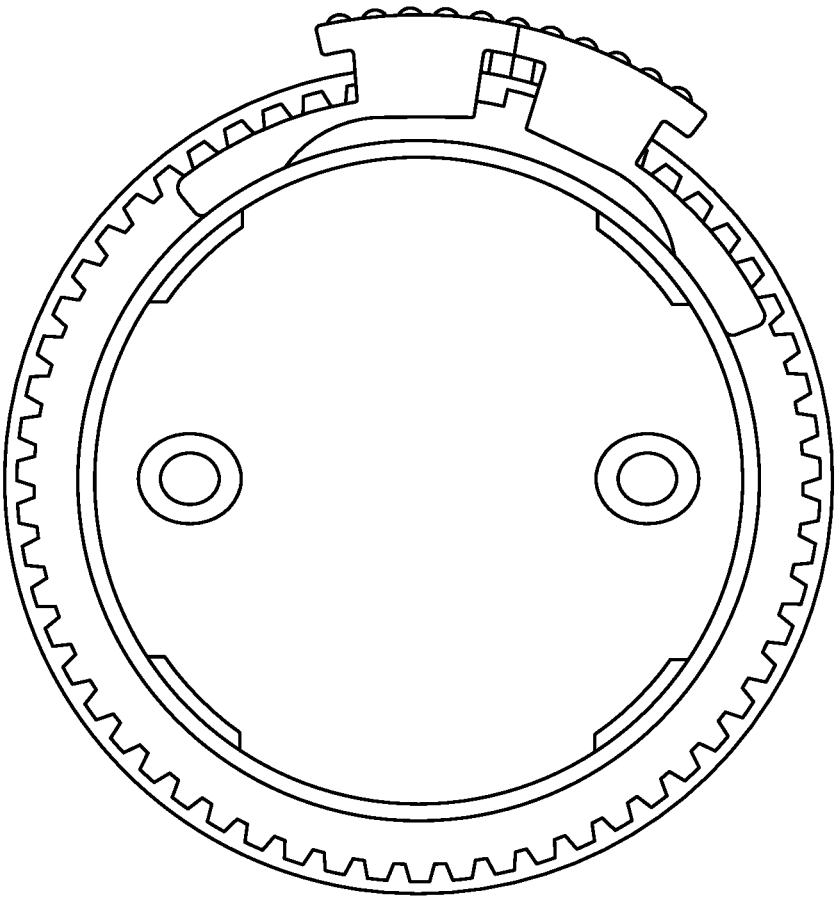

FIGS. 10 and 11 illustrate two indicator slides 1000, 1002, in which the indicator slide 1000 "leads" and the other indicator slide 1002 "follows". This allows the user to record both the dose he took and the next dose to take.

Each slide 1000, 1002 includes a respective indicator nose 1004, 1006. It is to be understood that the slides 1000, 1002 are in all essential respects identical in configuration and operation as the indicator slide 34 described previously, sliding in concert side by side with each other or independently of each other between a top 1008 and base 1010 configured as corresponding components described previously.

While particular structures and techniques are herein described in detail, it is to be understood that the subject matter which is encompassed by the present invention is limited only by the claims.

Components included in one embodiment can be used in other embodiments in any appropriate combination. For example, any of the various components described herein and/or depicted in the Figures may be combined, interchanged, or excluded from other embodiments.

"A system having at least one of A, B, and C" (likewise "a system having at least one of A, B, or C" and "a system having at least one of A, B, C") includes systems that have A alone, B alone, C alone, A and B together, A and C together, B and C together, and/or A, B, and C together, etc.

What is claimed is:

1. An apparatus comprising:

a disc-shaped label;

a disc-shaped top having a top surface supporting the label;

a disc-shaped base engaged with the top, the base comprising an outer periphery defining an inner surface and plural first ratchet teeth spaced around the inner surface; and an indicator slide comprising a finger pad formed with an inwardly-protruding indicator nose and leaf spring arms coupled to the finger pad through first and second legs and disposed intermediate the top and base, the leaf spring arms being formed with at least one second ratchet tooth configured to engage first ratchet teeth on the base and being deformable under pressure from the finger pad, wherein the finger pad is pressable inwardly against the leaf spring arms to disengage the second ratchet tooth from the first ratchet teeth and allow the indicator slide to slide relative to the top with the indicator nose higher than and alignable with time indicia on the label, the finger pad being releasable to allow the second ratchet tooth to engage first ratchet teeth under material bias of the leaf spring arms and prevent the indicator slide from sliding around the top.

2. The apparatus of claim 1, wherein the label is waterproof.

3. The apparatus of claim 1, wherein the label is an indicator label.

4. The apparatus of claim 1, wherein the indicator slide comprises at least two second ratchet teeth.

5. The apparatus of claim 1, wherein the finger pad is shaped as an arcuate plate.

6. The apparatus of claim 1, wherein the leaf spring arms are arcuate.

7. The apparatus of claim 6, wherein the finger pad is intermediate ends of the leaf spring arms.

8. The apparatus of claim 1, comprising a dust ring disposed in a slot formed between the top and base, an outer periphery of the dust ring being substantially flush with outer peripheries of the top and base.

9. The apparatus of claim 8, wherein the dust ring is integral with the indicator slide.

10. The apparatus of claim 8, wherein the dust ring is not integral with the indicator slide.

11. A pill bottle top comprising:

a top with a top surface supporting time indicia;

a base engaged with the top and comprising first ratchet teeth; and an indicator slide comprising a finger pad formed with an inwardly-protruding indicator and resilient arms coupled to the finger pad, the arms being formed with at least one second ratchet tooth configured to engage first ratchet teeth on the base and being deformable under pressure from the finger pad, wherein the finger pad is pressable inwardly toward the arms to deform the arms to disengage the second ratchet tooth from the first ratchet teeth and allow the indicator slide to slide relative to the top with the indicator higher than and alignable with the time indicia, the finger pad being releasable to allow the second ratchet tooth to engage first ratchet teeth under material bias of the arms and prevent the indicator slide from sliding.

12. The pill bottle top of claim 11, comprising a waterproof label bearing the time indicia.

13. The pill bottle top of claim 11, wherein the indicator slide comprises at least two second ratchet teeth.

14. The pill bottle top of claim 11, wherein the finger pad is shaped as an arcuate plate.

15. The pill bottle top of claim 11, wherein the arms are arcuate.

16. The pill bottle top of claim 15, wherein the finger pad is intermediate ends of the arms.

17. The pill bottle top of claim 11, comprising a dust ring disposed in a slot formed between the top and base, an outer periphery of the dust ring being substantially flush with outer peripheries of the top and base.

18. The pill bottle top of claim 17, wherein the dust ring is integral with the indicator slide.

19. The pill bottle top of claim 17, wherein the dust ring is not integral with the indicator slide.

* * * * *